US006607450B1

(12) United States Patent
Hackman

(10) Patent No.: US 6,607,450 B1
(45) Date of Patent: Aug. 19, 2003

(54) GOLF SWING FREQUENCY ANALYZER

(76) Inventor: Lloyd E. Hackman, 15508 Fiddlesticks Blvd. SE., Ft. Myers, FL (US) 33912

( * ) Notice: Subject to any disclaimer, the term of this patent is extended or adjusted under 35 U.S.C. 154(b) by 0 days.

(21) Appl. No.: 09/807,716

(22) PCT Filed: Nov. 16, 1999

(86) PCT No.: PCT/US99/27211

§ 371 (c)(1),
(2), (4) Date: Apr. 17, 2001

(87) PCT Pub. No.: WO00/29075

PCT Pub. Date: May 25, 2000

Related U.S. Application Data

(63) Continuation-in-part of application No. 09/193,171, filed on Nov. 16, 1998, now abandoned.

(51) Int. Cl.[7] ..... A63B 69/36
(52) U.S. Cl. ..... 473/223; 473/233
(58) Field of Search ..... 473/202, 221, 473/223, 224, 226, 233, 234, 241, 409

(56) References Cited

U.S. PATENT DOCUMENTS 3,106,403 A * 10/1963 Kirkman
3,270,564 A * 9/1966 Evans
3,788,647 A * 1/1974 Evans
3,945,646 A * 3/1976 Hammond
4,684,133 A * 8/1987 Maroth
4,699,379 A * 10/1987 Chateau
4,789,160 A * 12/1988 Dollar, Jr. et al.
4,878,667 A * 11/1989 Tosti
4,967,596 A * 11/1990 Rilling et al.
5,118,102 A * 6/1992 Bahill et al.
5,131,660 A * 7/1992 Marocco
5,233,544 A * 8/1993 Kobayashi
5,277,428 A * 1/1994 Goodwin et al.
5,351,951 A * 10/1994 Hodgetts
5,351,952 A 10/1994 Hackman
5,460,378 A * 10/1995 Getts
5,478,073 A 12/1995 Hackman
5,776,006 A * 7/1998 Gruber
5,895,328 A * 4/1999 Pahio
5,911,635 A * 6/1999 Ogden
5,964,668 A * 10/1999 Tai et al.

* cited by examiner

*Primary Examiner*—William M. Pierce
(74) *Attorney, Agent, or Firm*—Jason H. Foster; Kremblas, Foster, Phillips & Pollick

(57) ABSTRACT

A golf swing analyzer that can be attached to a golf club shaft. The analyzer includes a housing with an integral shaft mount. The housing contains an internal chamber in which an accelerometer, microprocessor and data storage are contained, and an output display screen mounted to the housing. The analyzer measures acceleration during a golfer's swing and calculates the frequency of a club that would be straight at ball impact.

28 Claims, 6 Drawing Sheets

GOLF SWING FREQUENCY ANALYZER

CROSS-REFERENCES TO RELATED APPLICATIONS

This application is a continuation-in-part of application Ser. No. 09/193,171, filed Nov. 16, 1998, now abandoned.

BACKGROUND OF THE INVENTION

1. Field of the Invention

The invention relates to golf devices, and more specifically to a device for measuring the acceleration of a golfer's swing for the purpose of matching a golf club having a desired frequency of oscillation to the golfer's swing.

2. Description of the Related Art

A golf club is a flexible rod which, when driven toward a ball by the golfer's hands, bends like a spring under the force applied to it. As the club head advances rapidly toward the ball, the shaft straightens. At some point in the swing, the striking face of the club head strikes the ball.

Striking faces are designed to strike a ball when the club's shaft is straight, imparting the desired loft to the ball due to the angle of the striking face at impact. If the ball is struck when the shaft is bent, the club head's striking face is not properly angled relative to the ball. A misaligned striking face results in an unsatisfactory drive, and therefore it is preferred that a club shaft be straight when the striking face and ball meet.

Additionally, when the shaft is straight, maximum club head velocity relative to the rest of the shaft is obtained. For this reason also a straight shaft is preferred at ball impact.

Some shaft deflection may be caused by centrifugal force when the center of gravity of the golf club head is not aligned with the shaft axis. However, this phenomenon is not considered here as part of the ball striking mechanism due to its unpredictability and unquantifiability. For the purpose of the present invention, the center of gravity is assumed to be aligned along the shaft's axis.

Because a shaft is bent early in a swing, the shaft must straighten as the swing proceeds. In order for a bent shaft to straighten between the time of maximum acceleration and ball impact, the shaft must be very carefully matched to the characteristics of the golfer's swing. Such matching requires consideration of the physical properties of the club and the application of force to the club through the golfer's hands.

A golf club has a rest axis, which is the axis of the shaft when the shaft is straight. The force applied through the golfer's hands bends the shaft from the rest axis. The force due to acceleration of the club by the golfer results in a bending force applied to the club, thereby bending the shaft from the rest axis.

When the acceleration of the golf club is at its maximum, and therefore the force due to acceleration is at its maximum, the shaft is bent the maximum amount. At maximum acceleration the velocity of the club head relative to the rest axis is zero, because the club has not begun to straighten from its most bent position.

When acceleration begins to decrease from a maximum, the force bending the shaft decreases, and the shaft begins to straighten. At this time, relative velocity begins to increase from zero. As acceleration continues to decrease, velocity continues to increase, with a maximum relative velocity occurring when acceleration of the head with respect to the shaft reaches zero.

A club shaft can only be straight at the time of ball impact if the club has a shaft stiffness and club head mass matched to the golfer's swing. The stiffness and mass properties determine how fast the club returns to straight from bent. Only if these properties are matched to the manner in which the golfer applies force to the club will the club have a straight shaft at ball impact.

A method of determining the golf club properties necessary to return the golfer's shaft to straight at ball impact is the subject of U.S. Pat. No. 5,351,952 to Hackman, which is incorporated by reference. In this patent, a method is discussed for calculating a natural frequency of oscillation of the golf club that matches the swing time of the golfer's swing. If a club is built to the frequency that is determined mathematically to match the golfer's swing, then it will return to straight by the time of ball impact.

Although it is possible to measure the characteristics needed to determine the frequency a golf club must have to match a particular golfer's swing, it is somewhat difficult. In conventional measurement devices, an accelerometer is fastened to the club head of a golf club, and is connected by wires (or wireless transceiver) to a computer.

This apparatus is functional, but its use is limited to an artificial environment, such as an indoor booth or driving range. In such an environment, the golfer may not actually swing in a normal manner, despite the efforts of the golfer to reproduce his normal swing.

U.S. Pat. No. 5,478,073 to Hackman, which is also incorporated by reference, discloses a method of calculating the length of that portion of a shaft that must be removed in order to give the shaft the desired final frequency. This process, known as "tipping" involves cutting off a small portion of the shaft to increase the shaft's stiffness, and therefore its frequency of oscillation. The shaft is tipped by the calculated amount and a club head is attached, resulting in a club that matches the golfer's swing. Such a matching club will straighten by ball impact from bent at maximum acceleration.

The need exists for an apparatus which can be used during normal golf activities, so as to encourage the golfer to swing in the normal playing manner, thereby making for a more accurate match between golf club and golfer.

SUMMARY OF THE INVENTION

The invention is a golf swing analyzer attachable to a golf club. The analyzer comprises a housing and a shaft mount attached to the housing for attaching the housing to a golf club shaft. An accelerometer and microprocessor are mounted within the housing. The microprocessor is connected to the accelerometer for processing acceleration measurements made by the accelerometer. A data storage is mounted within the housing and is connected to the microprocessor. The invention also comprises an output port connected to the microprocessor. In one embodiment, the shaft mount further comprises a clamp having a pair of opposed lips for positioning on opposite sides of the golf club shaft and clampingly gripping said shaft between said lips.

In a preferred embodiment, the housing comprises a pair of opposed shells pivotably mounted together along one edge at a hinge. Each shell has a shaft-receiving surface at its opposite ends. The shaft-receiving surfaces of the opposed shells seat against, surround and frictionally grip a golf club shaft when the analyzer is mounted to the shaft in an operable position. One of the opposing shells of the analyzer has C-shaped retaining latches pivotably mounted thereto for pivoting around a portion of each shell's shaft receiving surface when the analyzer is mounted to a golf club shaft in an operable position.

The invention also contemplates a method of matching a golf club of a preferred frequency to a golfer's golf swing. The method comprises the golfer swinging a golf club, and measuring the acceleration of the golf club at multiple times during swinging. A maximum acceleration datum is selected, as are a first datum and a second datum. The first datum is measured a predetermined time before the maximum acceleration datum, and the second datum is measured a time after the maximum acceleration datum substantially similar to the predetermined time. A substantially parabolic curve is fit through the first datum, the second datum and the maximum acceleration datum. A measurement time of a new maximum acceleration datum is determined at the peak of the parabolic curve. The method includes determining a swing time between the time of the new maximum acceleration datum and ball impact, and calculating swing frequency by the equation: frequency=15,000÷(swing time).

An alternative method of determining the frequency of the properly matched golfer's club is contemplated. The method includes two steps: calculation of swing time; and calculation of a swing time using a correction factor, k. In calculating the swing time, a candidate for a release point is selected and a sine wave curve data set is constructed from an equation and the angular acceleration data set. These data sets are subtracted from one another and the differences are summed. If the sum ever reaches a predetermined value, the candidate is rejected. If not, the candidate is accepted and the swing time is calculated with a correction factor that is based upon an equation that is a function of the club's velocity at the release point.

Figure 1:
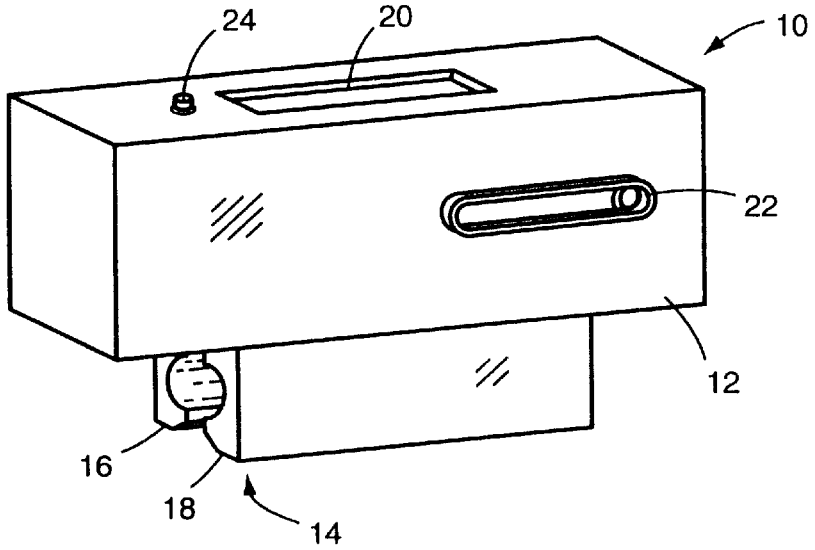
FIG. 1 is a view in perspective illustrating the preferred embodiment.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other elements where such connection is recognized as being equivalent by those skilled in the art.

BRIEF DESCRIPTION OF THE PREFERRED EMBODIMENT

Figure 2:
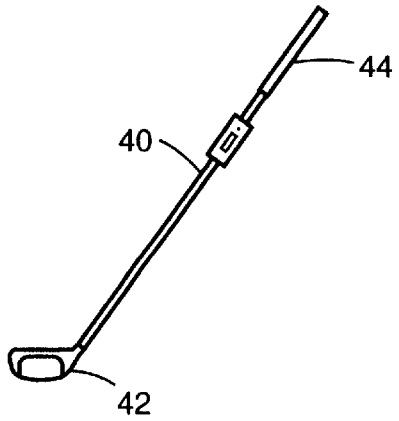
FIG. 2 is a view in perspective illustrating the preferred embodiment in an operable position attached to a golf club.
Figure 3:
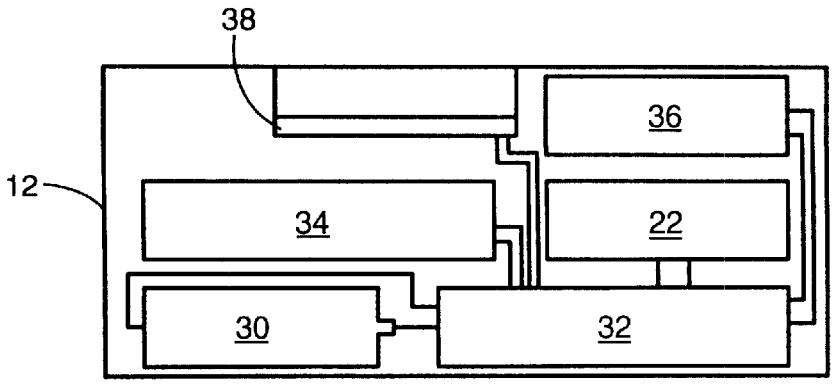
FIG. 3 is a schematic view illustrating the inner chamber of the preferred embodiment's housing, and the electronic components housed therein.

The analyzer 10, shown in FIG. 1, has an elongated parallelepiped housing 12. The housing is preferably made of a polymer, and has an internal chamber (shown schematically in FIG. 3) which houses electronic components. A shaft mount 14, preferably a clamp having a pair of opposed lips 16 and 18, is mounted to the underside of the housing 12, preferably integrally with the housing 12. The opposed lips are positioned on opposite sides of a golf club shaft in the operable position, clampingly gripping the shaft between the lips as shown in FIG. 2. Of course, many other structures are contemplated as adequate substitutions for the preferred shaft mount for attaching the analyzer to a golf club shaft. Spring-biased clamps, screws, double-sided tape, pipe clamps or tape wrapped around the shaft and housing 12, etc. could all be substituted for the shaft mount 14.

The display screen 20 is mounted in the upper wall of the housing 12 for displaying an output. The screen 20 is preferably a liquid crystal display or light emitting diode which displays alphanumeric characters and/or other symbols. The screen 20 can display the swing time of the last swing, an integer that indicates the difference between the swing time of the last swing and another swing time, the remaining number of swings that can be stored by the analyzer, or any other information.

The display screen 20 is connected to an output port. The output port is an entry/exit boundary mechanism that facilitates the flow of data into and out of the microprocessor (discussed below). The preferred output port includes at least two conductors connected to the microprocessor. Output devices can be connected to the output port. Such devices include radio frequency transceivers, infrared transceivers and optical, tactile and audio transducers.

The electrical connector 22 is mounted in the side wall of the housing 12 and connects to the output port. The connector 22 is preferably a conventional socket that can receive a mating plug that electrically connects to a personal computer. The connector 22 permits the analyzer 10 to transmit information to another machine, such as a personal computer, for further, and perhaps more complex, computation. Connectors which can accomplish such purposes are too great in number to name, but are known to those of ordinary skill in the art.

An input, preferably the finger actuatable switch 24, is mounted in the upper wall of the housing 12. The switch 24 permits a user to select options presented to him in the display screen 20. Of course, the switch 24 could permit additional input, and could be substituted by any other conventional input device, such as a multiple key keyboard, a pointing device, such as a trackball, or verbal input.

Electronic components are mounted within the chamber of the housing 12. These are shown schematically in FIG. 3 mounted to the housing for protection and to maintain their relative positions. The energy source, preferably the battery 30, is electrically connected to the microprocessor 32. The microprocessor 32 is connected to the accelerometer 34 and the output port 22. The data storage 36 and the display screen device 20 are also connected to the microprocessor 32. All of the electrical components function individually in a manner that is conventional for each component.

The analyzer 10 measures the acceleration of each swing and then calculates the frequency that a golf club must have to match the swing of the golfer whose club the analyzer is attached to. The calculated frequency and full swing data, for up to 61 swings, is stored in the data storage 36. These full swing data are of interest because they can be interpreted by a skilled person to assess problems in a golfer's swing, or reasons why a golf club of a particular frequency does not match a golfer's swing.

Figure 4:
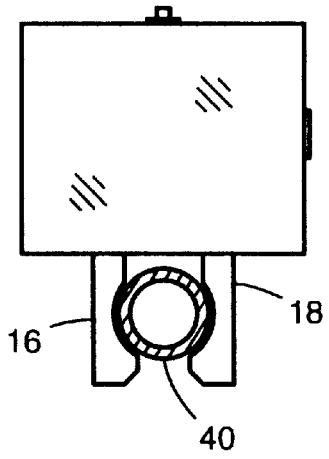
FIG. 4 is an end view illustrating the preferred embodiment attached to a golf club shaft.
Figure 5:
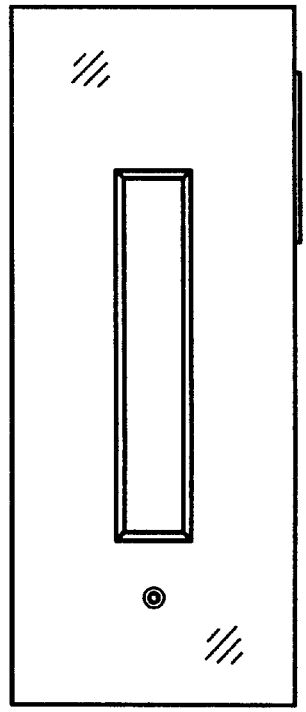
FIG. 5 is a top view illustrating the preferred embodiment.

The analyzer 10 is mounted in its operable position to the shaft 40 of a conventional golf club by clamping the lips 16 and 18 around the shaft 40 as shown in FIGS. 2 and 4. The shaft 40 is forced into the gap between the lips 16 and 18. Typically, the analyzer 10 is mounted to the small diameter region of the shaft near the club head 42, and then it is slid along the shaft toward the larger diameter region of the shaft near the grip 44 until the frictional engagement between the opposing inner surfaces of the lips and the outer surface of the shaft 40 is sufficient to hold the analyzer 10 in place during swinging of the golf club.

Once the analyzer 10 is mounted in its operable position, the golfer swings the club in a conventional manner. During the swing, the accelerometer 34 measures the radial acceleration. The microprocessor 32 receives the signal from the accelerometer 34 and samples it at predetermined time intervals; for example, every 2 milliseconds. The microprocessor 32 stores the acceleration measurement data in the data storage 36; for example, in a two dimensional array.

The microprocessor then calculates, and then the display screen 20 displays, the natural frequency of oscillation a golf club must have to match the golfer's swing. This frequency can be used to build a golf club. However, because there are often problems with golfers' swings that should be corrected prior to building an expensive set of custom clubs, it is often desirable to hide from users the swing times and frequencies of their swings. Therefore, after determining the frequency, the analyzer 10, using an "encrypting" algorithm, can merely convert the frequency into an integer between, for example, 1 and 50. This integer is then displayed on the screen 20 to indicate to the golfer how his swing differs from some previous or ideal swing. This encourages consistency before building a set of matched clubs.

The analyzer 10 can be used on any club length in a set. Once the analyzer is mounted to a club shaft, the user enters the length of the club using the switch 24. Any stored swing data also includes the club's length, so that the data for each club length can be kept separate from data for clubs of different lengths. For example, the analyzer 10 can be used on a driver, then an iron, then a different driver, then a pitching wedge. For each different club, a new club length is entered at the switch 24. A set of clubs, each of which matches the golfer's swing for that club length, can then be built.

During measured swings, radial acceleration, which is the acceleration in the direction along the length of the golf club shaft, is measured as discussed above. A bidirectional accelerometer, which also measures the acceleration perpendicular to the club shaft, can also be used. With such an accelerometer, one can use the same analyzer to measure the natural frequency of oscillation of a particular golf club when clamped in a standard, five inch clamp, bent and then released.

Although the radial acceleration of a golfer's swing is the characteristic being measured, it is the angular acceleration of the swing that is necessary for calculating a matching frequency. Radial acceleration is proportional to angular velocity. Therefore, the microprocessor 32 is programmed to differentiate the radial acceleration to obtain a set of data that, although numerically different from angular acceleration, varies from datum to datum proportionally to the actual angular acceleration data. For the present invention, it is the maximum angular acceleration, and the abrupt change in angular acceleration pattern, typical of a shock wave, due to ball impact, that are of interest to the frequency calculation.

Once the angular acceleration data are obtained, the time of the maximum acceleration datum is determined. Next, the data are compared to find the point of abrupt change in acceleration of about 7 to 15% or more that occurs at ball impact. The time that elapses between these two data points is determined, and is denoted the "swing time." The swing time is the amount of time it takes a golfer's club to advance through the swing from maximum acceleration to ball impact. The swing time is assumed to be the amount of time it takes a properly fitted golf club to straighten from fully bent. The natural frequency of oscillation, f, of the desired golf club is related to the swing time, t, by the equation $$f=(15{,}000)\div t.$$

The frequency of a matching golf club is therefore determined by inserting the swing time, t, into the above equation.

Figure 6:
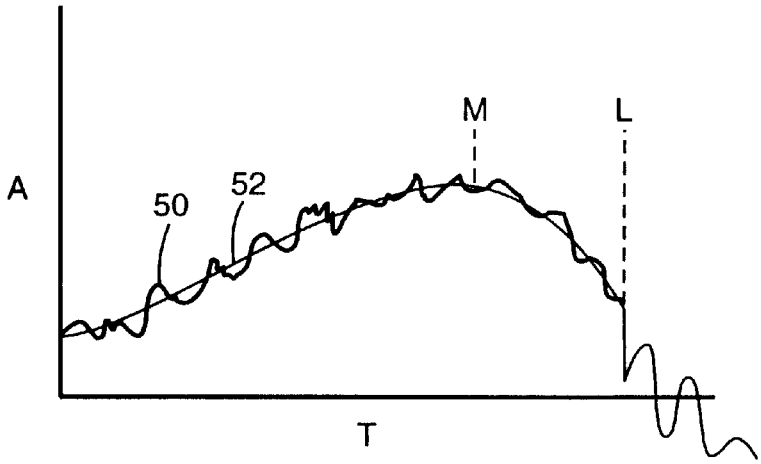
FIG. 6 is a graph of angular acceleration versus time.
Figure 7:
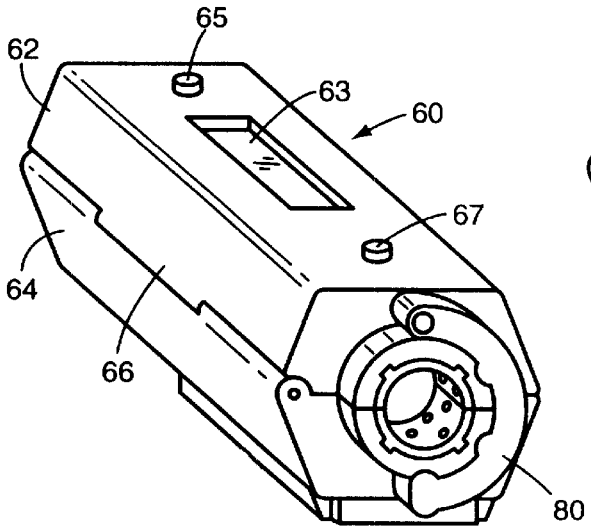
FIG. 7 is a view in perspective illustrating a preferred analyzer housing in the closed position.
Figure 8:
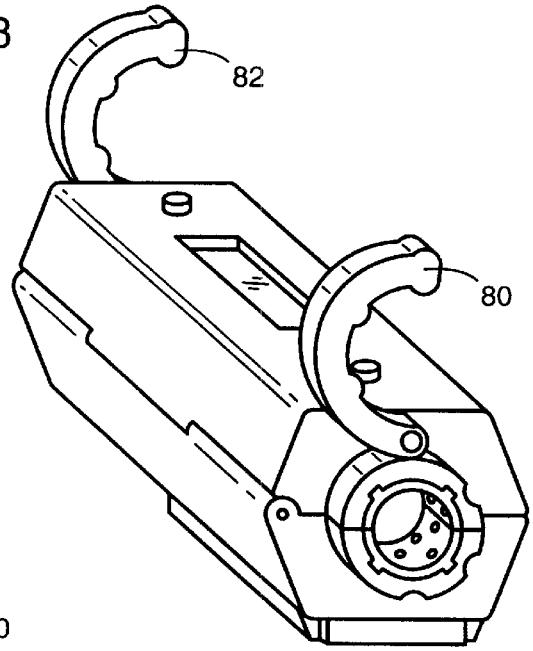
FIG. 8 is a view in perspective illustrating a preferred analyzer housing in the position with the C-shaped latches in an open position.
Figure 9:
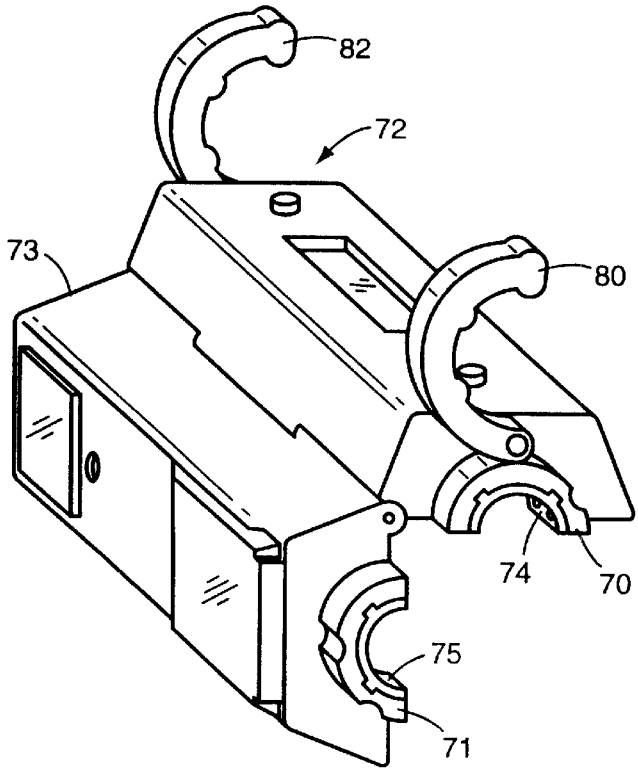
FIG. 9 is a view in perspective illustrating a preferred analyzer housing in the opened position.

Although the swing time can be calculated in the simple manner described above, some error can result. In order to more accurately determine the swing time, the acceleration data are adjusted to remove possible sources of error before the frequency is calculated. If the acceleration data are plotted against time, a curve 50 shown in FIG. 6 is formed. The curve 50 has a similar overall curvature to the curve 52, but with noise inherent in human motion. The noise is a potential source of error that is removed by an adjustment process to obtain data which, if plotted, would produce a smoother curve that is more like the curve 52 than the curve 50.

The data which would produce the curve 50 are smoothed by a mathematical process. As a first step, the slope between two data points is calculated. For example, the slope between the first datum and the twelfth datum is calculated. The acceleration data are sampled at, for example, 2 millisecond intervals as described above. Therefore, the time period between the first datum and the twelfth datum is 22 milliseconds. The slope of this 22 millisecond interval is attributed to a 2 millisecond interval in the second set of data located at an intermediate time in the 22 millisecond interval, for example, between the sixth and seventh data, between ten and twelve milliseconds.

Next, the slope between the second datum and the thirteenth datum is calculated, and then that slope is attributed to the two millisecond interval at an intermediate time in the 22 millisecond interval between the second datum and thirteenth datum, for example, between the seventh and eighth data, between twelve and fourteen milliseconds. This process continues until the second set of data is constructed for essentially the time period of the first set of acceleration data.

After reducing the noise in the data, the next step is the selection of the maximum acceleration datum. The preferred first step in doing so is the selection of two data which were sampled from the accelerometer at substantially equal amounts of time before and after the maximum acceleration datum. Then a parabolic curve is fitted through the two data and the maximum acceleration datum. Next, a maximum that falls on the parabola is determined by finding the point on that parabola at which the slope equals zero.

A parabola has an equation of the form $y=Ax^2+Bx+C$. With the three data selected, this equation can be solved for A, B and C, and then the slope can be found by differentiating the equation with respect to x, setting dy/dx equal to zero and solving for x. This gives the time of the measured acceleration datum at which slope equals zero, which is the time at which acceleration is at its maximum.

It is possible to have multiple peaks in an extremely noisy set of data, many of which may appear to be the maximum acceleration. Therefore, in the above process errors may be caused by, or processor time consumed with rejection of, such peaks. However, there are boundaries which, relative to the time of ball impact, no maximum acceleration point would ever exist beyond. No maximum acceleration would exist there, because maximum accelerations beyond such boundaries would result in golf clubs of frequency no human could ever practically build or use. Therefore, processor time is not taken up by considering any maximum below a certain point, such as 32 milliseconds before ball impact, or above a certain point, such as 100 milliseconds before ball impact. A maximum acceleration less than 32 milliseconds before ball impact would result in a club frequency of over 469 cycles per minute. A maximum acceleration more than 100 milliseconds before ball impact would result in a club with frequency of less than 150 cycles per minute. No useable golf club would ever be built with these physical characteristics, because no one needs a club with a frequency below 150 or above 468. Therefore, the only data considered when selecting a maximum acceleration datum is between about 32 and about 100 milliseconds before ball impact. Of course, the points of cutoff could be changed depending on processor capabilities, sensitivity of accelerometer, etc.

Once the noise in the data has been reduced, and the maximum acceleration datum has been accurately obtained, the swing time can be calculated as described above. Once the swing time is calculated, the desired frequency of a matching golf club is calculated and then displayed, stored and/or changed into an encrypted indicator of frequency. The golfer can then use the displayed information to have a custom golf club built, or to adjust his swing to be more consistent. The data can also be transmitted to a personal computer for more sophisticated calculations or analysis.

An alternative method of determining the frequency of the golfer's club with increased accuracy is described below. The method involves two steps: first, calculating swing time; second, inserting a correction factor into the frequency calculation described above ($f=15{,}000/t$). The swing time calculation is described below first.

Once a data set of raw swing data (radial acceleration) is obtained in a two dimensional array as described above, the data set is differentiated to obtain a data set proportional to angular acceleration. This angular acceleration data set is preferably in a two dimensional array having x and y values, where the y value corresponds to angular acceleration at the time, x, that the measurement is taken.

Next, ball impact is found as described above at a sudden drop in the radial acceleration. Once the time of ball impact is determined, the "release point" must be determined. The release point is the point in time when the club shaft significantly begins to release the stored energy of the bent shaft. The release point is necessary to this enhanced method of finding the swing time.

It has been discovered that the release point often coincides with the maximum acceleration, but not always. For example, if there are two large acceleration points close in time to one another, the release point may be at one of the points, it may be at the other, or it may be near one or the other. If the club shaft is reloaded at the second large acceleration point, then the swing time should be measured from that point. Therefore, when calculating swing time in the enhanced method contemplated, the release point, rather than the maximum acceleration point, is used. The maximum acceleration point is the first "candidate" considered when determining the time of the release point.

In determining the time of the release point, the processor only considers acceleration data in the "window" from about 32 to about 100 milliseconds before ball impact. As described above, release points outside this window would result in useless club frequencies.

The first release point candidate is the maximum acceleration datum in the window, although the first candidate could be the next datum or two later, etc. In order to determine whether the candidate is the actual release point, a sine wave data set is constructed based upon the equation $y_s=(\sin\Theta)*(y_c)$. This permits the comparison of the angular acceleration curve to a sine wave curve, which the angular acceleration curve ideally should approximate or fall below.

In the above equation, $y_c$ is a constant equal to the angular acceleration of the release point candidate, and $\Theta$ is an angle increasing from 90° at the release point candidate to 180° at ball impact. The 90° difference between the release point and ball impact is divided by as many angular acceleration data as there are between the release point candidate and ball impact. The sine wave data set is constructed by calculating a $y_s$ for each angular acceleration quantity in the array.

With this sine wave data set, the y values of the angular acceleration "curve" can be compared to the $y_s$ values of the sine wave "curve" that mathematically extends from the release point candidate to ball impact.

Once the sine wave data set is constructed for the release point candidate, the angular acceleration is subtracted from $y_s$ beginning with the release point candidate and progressing forward in time toward ball impact. After the difference between the next angular acceleration and the corresponding $y_s$ is determined, this difference and the difference at the release point candidate are summed. If this sum is less than zero the calculations cease and the release point candidate is disqualified as a release point. Then the process begins again for the next datum closer to ball impact. But as long as the sum of the differences never becomes negative, the differences between the subsequent angular acceleration data and their corresponding $y_s$ quantities will be calculated until the ball impact datum is reached. If the sum is never negative, that candidate becomes the release point. If it does become negative, a new release point candidate is selected. The new release point is the next subsequent datum of the angular acceleration data set.

For this new release point candidate, a new sine wave data set is constructed extending from the new release point candidate to ball impact, and the new $y_s$ quantities are subtracted from the angular acceleration quantities. If the total of these differences ever drops below zero, the process starts again with the next release point candidate.

This process continues until the total of the differences remains greater than zero all the way to the angular acceleration point that corresponds to ball impact. When this occurs, the time of the release point candidate is stored as the release point, and the amount of time from the release point to ball impact is calculated and stored as swing time.

Of course, in the calculations for determining the release point, it is possible to be stricter or more liberal about when to disqualify a release point candidate. For example, if the total of the differences ever drops below a particular positive amount, the release point candidate could be disqualified, which would be a stricter standard. Alternatively, the release point candidate could be disqualified only when the total of the differences drops below a particular negative amount. In the preferred embodiment, the release point candidate is disqualified if the sum of the differences ever becomes negative, but a different standard could, of course, be adopted.

Once the swing time is calculated as described above, the frequency of the preferred club is calculated with the equation described above, but with the inclusion of a correction factor. The correction factor is necessary because of several factors that introduce additional response mechanisms or variables that must be accommodated in the frequency calculation.

One of these factors is centrifugal force, which is the radially directed force along a club shaft's length during swinging. This force tends to straighten a bent club shaft. Centrifugal force increases as club head velocity increases, and therefore a club's shaft tends to straighten more as it is swung faster.

Wind resistance, which increases as club velocity increases, tends to cause a golf club's shaft to bend more. Also, a golf club shaft is not held rigidly by a golfer's hands during swinging, and this introduces variations that must be accommodated.

The correction factor, k, is determined from the equation $$k=1-0.0007*v-(1.0E-5)*v^2$$

where v is the club head velocity at the release point. The correction factor equation is a parabolic equation, and the constants are functions of centrifugal force, wind resistance and the existence of a nonrigid support holding the club handle. The constants have been determined from studying the accuracy of frequency matching of different golfers, and could be changed somewhat from their current quantity as research progresses.

The correction factor, k is inserted into the frequency calculation equation to obtain $$f=(15{,}000*k)/t.$$

With this equation, the frequency, f of a club that matches a golfer's swing time, t is obtained.

Figure 10:
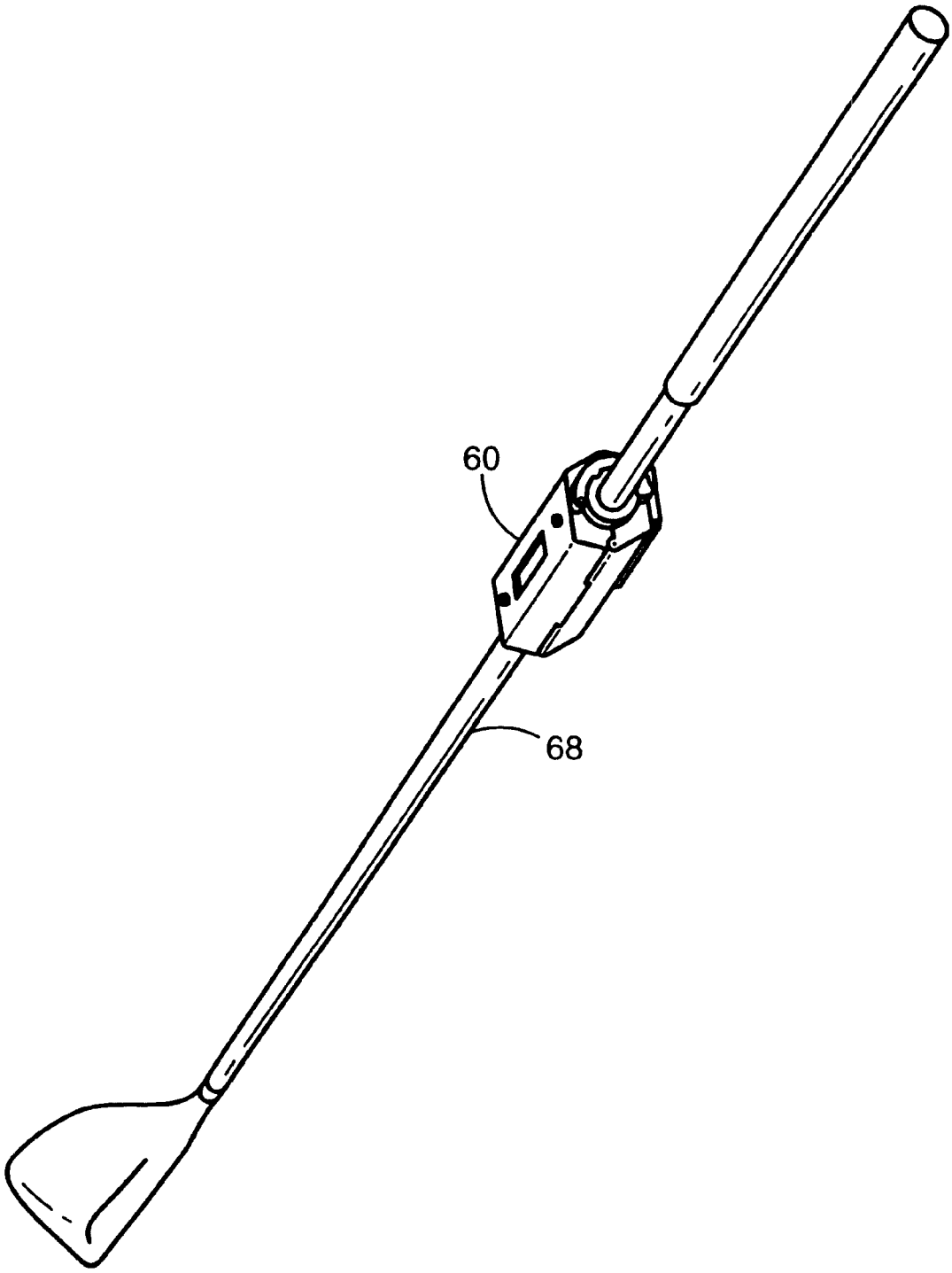
FIG. 10 is a view in perspective illustrating a preferred analyzer housing in the closed position and mounted in an operable position on a golf club shaft.
Figure 11:
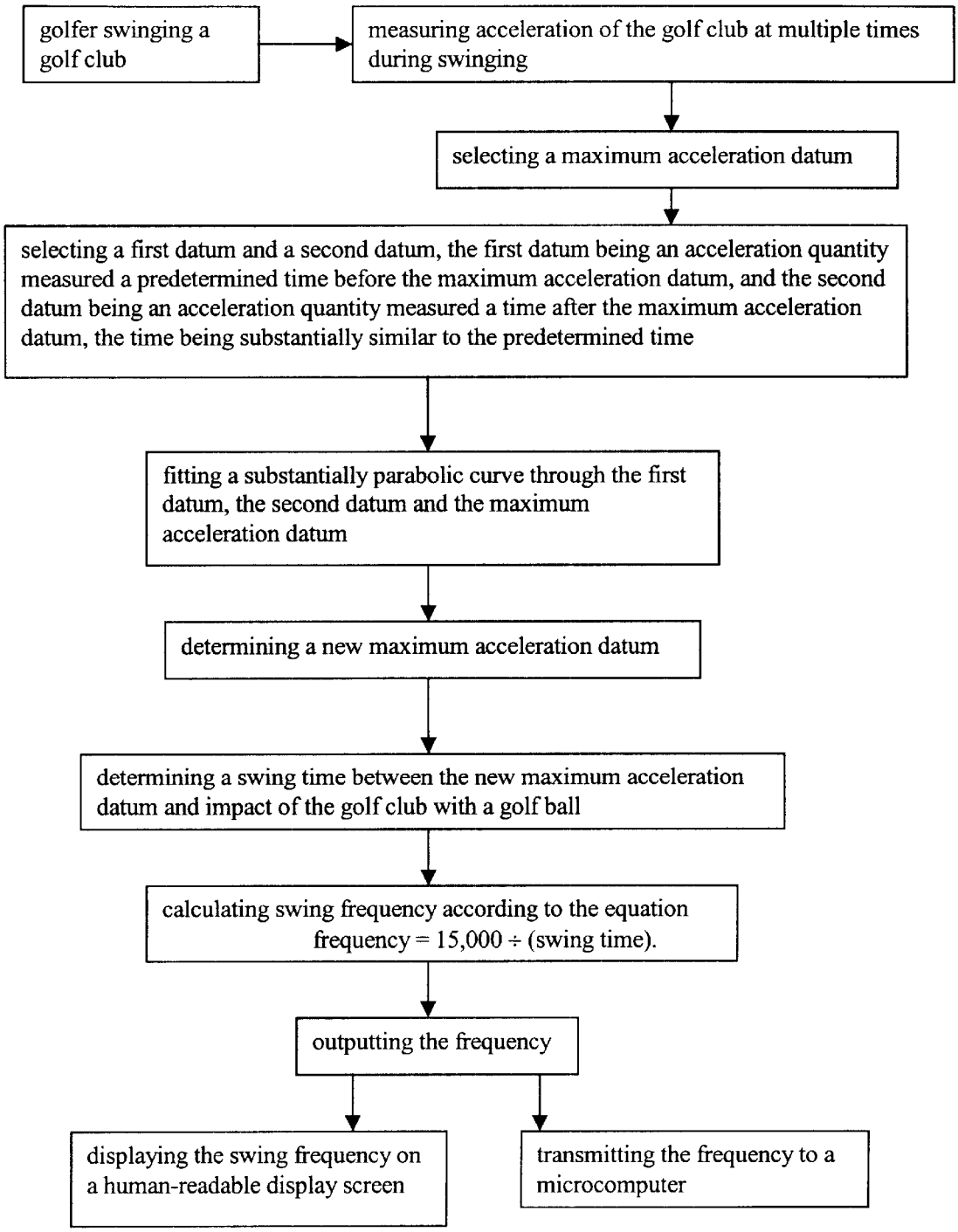
FIG. 11 is a flow chart illustrating method steps of the present invention.
Figure 12:
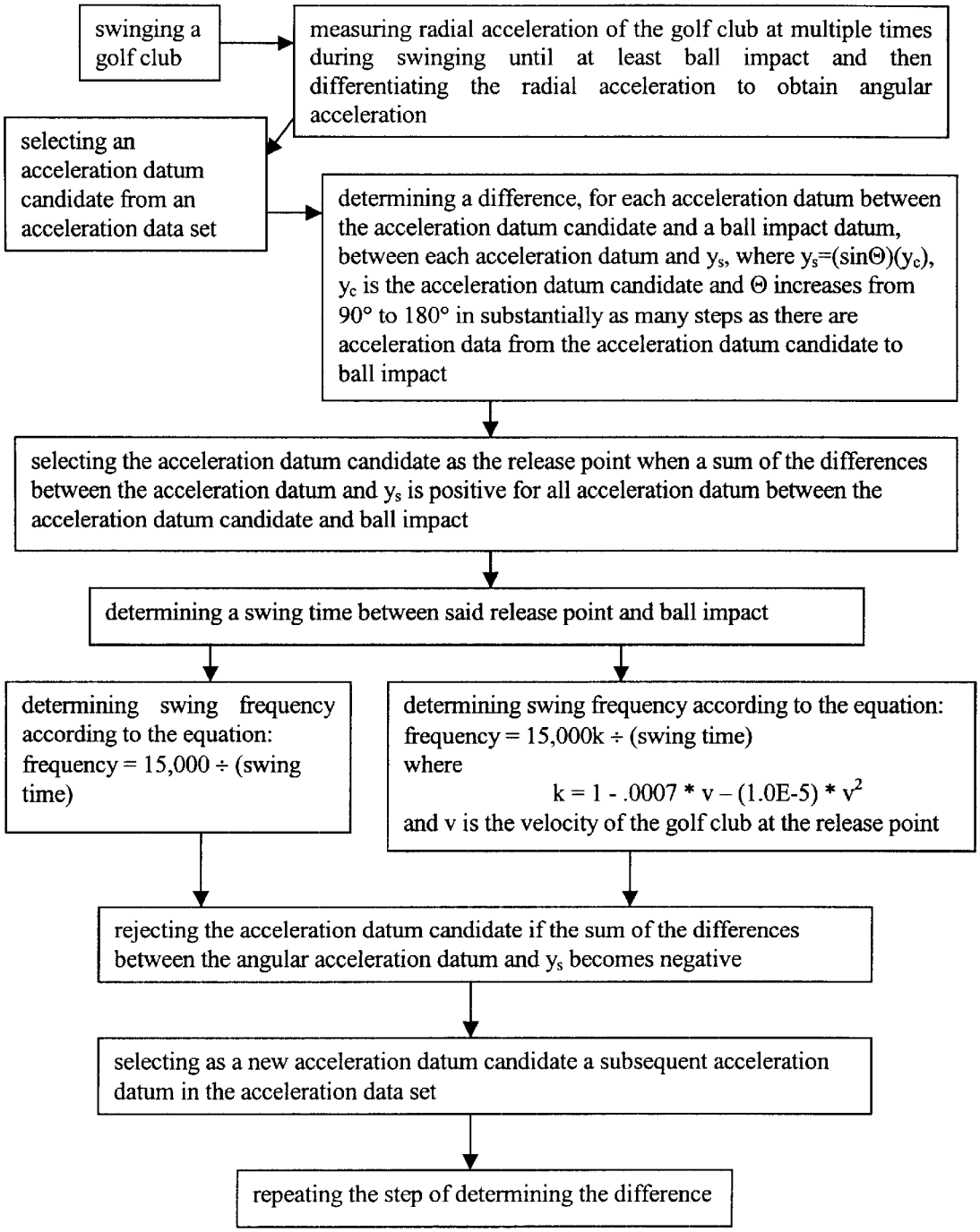
FIG. 12 is a flow chart illustrating method steps of the present invention.

An alternative housing 60 is shown in FIGS. 7, 8, 9 and 10. The housing 60 includes two opposing shells 62 and 64 that are pivotably mounted together along a long side at a hinge 66. The shells hinge together from an open position (shown in FIG. 9) to a closed position (shown in FIG. 7), receive and grip a golf club shaft 68 as shown in FIG. 10. It is preferred that the end of the housing 60 that is closest to the grip be positioned 16 inches from the butt end of the club shaft.

The display 63 and the switches 65 and 67 are mounted to the shell 62, and a processor and data storage are housed in the housing 60 as described above for the analyzer 10.

Each shell has an ear 70, 71, 72 and 73 at opposite ends, and each ear has an internally facing, shaft-receiving surface 74, 75, 76 and 78 (ears 72 and 73, and internally facing surfaces 76 and 78 are not shown in the drawings, but are essentially identical in structure and appearance to the ears and surfaces shown). The internally facing, shaft receiving surfaces of the ears are preferably made of a soft, high friction material that conforms to the outer surface of a golf club shaft.

When the shells 62 and 64 are closed around the shaft 68, the shaft receiving surfaces 74–78 seat against and frictionally grip the shaft 68. The C-shaped retaining latches 80 and 82 pivot about their axes and latch around at least a portion of both ears of both shells. The latches 80 and 82 have convex ridges that seat in concave indentations on the outer surfaces of the ears 70–73, thereby fixedly retaining the analyzer in a fixed position on the shaft 68. The analyzer is removed from the shaft 68 by manually pivoting the latches 80 and 82 away from the ears 70–73 and opening the shells 62 and 64.

While certain preferred embodiments of the present invention have been disclosed in detail, it is to be understood that various modifications may be adopted without departing from the spirit of the invention or scope of the following claims.

What is claimed is:

1. A golf swing analyzer in combination with a golf club having a shaft, the combination comprising:

(a) a housing grippingly enclosing a discrete length of the golf club shaft, wherein the housing is removably mounted to, and substantially coaxial with, the golf club shaft;

(d) an accelerometer mounted within the housing;

(e) a microprocessor mounted within the housing and connected to the accelerometer for processing acceleration measurements made by the accelerometer;

(f) a data storage mounted within the housing, and connected to the microprocessor; and (g) an output port connected to the microprocessor.

2. An analyzer in accordance with claim 1, wherein the shaft mount further comprises a clamp having a pair of opposed lips for positioning on opposite sides of the golf club shaft and clampingly gripping said shaft between said lips.

3. An analyzer in accordance with claim 1, further comprising an input connected to said microprocessor.

4. An analyzer in accordance with claim 3, wherein the input is a finger actuatable switch.

5. An analyzer in accordance with claim 3, wherein the input is a port for connecting to a microcomputer.

6. An analyzer in accordance with claim 1, further comprising a liquid crystal display connected to the output port and mounted to the housing.

7. An analyzer in accordance with claim 1, further comprising an electrical connector connected to the output port.

8. An analyzer in accordance with claim 1, further comprising a radio frequency transmitter connected to the output port.

9. An analyzer in accordance with claim 1, further comprising an infrared transmitter connected to the output port.

10. An analyzer in accordance with claim 1, wherein the accelerometer is bidirectional for measuring acceleration in two directions.

11. A method of matching a golf club of a preferred frequency to a golfer's golf swing, the method comprising:

(a) said golfer swinging a golf club;

(b) measuring acceleration of the golf club at multiple times during swinging;

(c) selecting a maximum acceleration datum;

(d) selecting a first datum and a second datum, said first datum being an acceleration quantity measured a predetermined time before the maximum acceleration datum, and said second datum being an acceleration quantity measured a time after the maximum acceleration datum, said time being substantially similar to said predetermined time;

(e) fitting a substantially parabolic curve through the first datum, the second datum and the maximum acceleration datum;

(f) determining a new maximum acceleration datum;

(g) determining a swing time between said new maximum acceleration datum and impact of the golf club with a golf ball; and (h) calculating swing frequency according to the equation $$\text{frequency}=15{,}000\div(\text{swing time}).$$

12. A method in accordance with claim 11, further comprising outputting said frequency.

13. A method in accordance with claim 12, wherein outputting further comprises displaying said swing frequency on a human-readable display screen.

14. A method in accordance with claim 12, wherein outputting further comprises transmitting said frequency to a microcomputer.

15. A method of matching a golf club of a preferred frequency to a golfer's golf swing, the method comprising:

(a) said golfer swinging a golf club;

(b) measuring acceleration of the golf club at multiple times during swinging until at least ball impact;

(c) selecting an acceleration datum candidate from an acceleration data set;

(d) determining a difference, for each acceleration datum between the acceleration datum candidate and a ball impact datum, between each acceleration datum and $y_s$, where $y_s=(\sin\Theta)(y_c)$, $y_c$ is the acceleration datum candidate and $\Theta$ increases from 90° to 180° in substantially as many steps as there are acceleration data from the acceleration datum candidate to ball impact;

(e) selecting the acceleration datum candidate as the release point when a sum of the differences between the acceleration datum and $y_s$ is positive for all acceleration datum between the acceleration datum candidate and ball impact;

(f) determining a swing time between said release point and ball impact; and (g) determining swing frequency according to the equation $$\text{frequency}=15{,}000\div(\text{swing time}).$$

16. A method in accordance with claim 15, further comprising (a) rejecting the acceleration datum candidate if the sum of the differences between the angular acceleration datum and $y_s$ becomes negative;

(b) selecting as a new acceleration datum candidate a subsequent acceleration datum in the acceleration data set; and (c) repeating the step of determining the difference.

17. A method in accordance with claim 15, wherein the acceleration datum candidate is a maximum acceleration datum.

18. A method in accordance with claim 15, wherein measuring acceleration of the golf club further comprises measuring radial acceleration and then differentiating the radial acceleration to obtain angular acceleration.

19. A method in accordance with claim 15, further comprising determining swing frequency according to the equation $$\text{frequency}=15{,}000k\div(\text{swing time})$$

where $$k=1-0.0007*v-(1.0E-5)*v^2$$

and v is the velocity of the golf club at the release point.

20. A golf swing analyzer attachable to a golf club, the analyzer comprising:

(a) a housing comprising (i) first and second shells pivotably mounted at an adjoining edge at a hinge;

(ii) shaft receiving, inwardly facing surfaces on opposite ends of each shell for seating against and grippingly engaging an outer surface of a golf club shaft;

(iii) retaining latches pivotably mounted at opposite ends of at least one of the shells for pivoting into a locked position;

(b) an accelerometer mounted within the housing;

(c) a microprocessor mounted within the housing and connected to the accelerometer for processing acceleration measurements made by the accelerometer;

(d) a data storage mounted within the housing, and connected to the microprocessor; and (e) an output port connected to the microprocessor.

21. An analyzer in accordance with claim 20, further comprising an input connected to said microprocessor.

22. An analyzer in accordance with claim 21, wherein the input is a finger actuatable switch.

23. An analyzer in accordance with claim 21, wherein the input is a port for connecting to a microcomputer.

24. An analyzer in accordance with claim 20, further comprising a liquid crystal display connected to the output port and mounted to the housing.

25. An analyzer in accordance with claim 20, further comprising an electrical connector connected to the output port.

26. An analyzer in accordance with claim 20, further comprising a radio frequency transmitter connected to the output port.

27. An analyzer in accordance with claim 20, further comprising an infrared transmitter connected to the output port.

28. An analyzer in accordance with claim 20, wherein the accelerometer is bidirectional for measuring acceleration in two directions.

* * * * *